US006634034B2

(12) United States Patent
Rendell

(10) Patent No.: US 6,634,034 B2
(45) Date of Patent: Oct. 21, 2003

(54) ADJUSTABLE TOILET FLANGE ASSEMBLY

(76) Inventor: Jeffrey D. Rendell, 564 Maloney, Oxford, MI (US) 48371

( * ) Notice: Subject to any disclaimer, the term of this patent is extended or adjusted under 35 U.S.C. 154(b) by 0 days.

(21) Appl. No.: 09/992,317

(22) Filed: Nov. 19, 2001

(65) Prior Publication Data

US 2003/0093855 A1 May 22, 2003

Related U.S. Application Data

(60) Provisional application No. 60/252,449, filed on Nov. 21, 2000.

(51) Int. Cl.[7] ..... E03D 11/16; E03D 11/17

(52) U.S. Cl. ..... 4/252.4; 4/252.5; 4/252.6; 285/56

(58) Field of Search ..... 4/252.1–252.6; 285/56–60, 42, 412, 414

(56) References Cited

U.S. PATENT DOCUMENTS

| | | | | | |
|---|---|---|---|---|---|
| 872,331 | A | | 12/1907 | Dreier | |
| 903,280 | A | | 11/1908 | Farrell | |
| 1,042,465 | A | | 10/1912 | Oakes | |
| 3,775,780 | A | | 12/1973 | McEwen | |
| 4,261,598 | A | * | 4/1981 | Cornwall | 285/56 |
| 4,827,539 | A | | 5/1989 | Kiziah | |
| 5,695,222 | A | * | 12/1997 | Hodges | 285/56 |
| 6,065,160 | A | | 5/2000 | Winn | |
| 6,070,910 | A | * | 6/2000 | Hodges | 4/252.6 |
| 6,101,774 | A | * | 8/2000 | Heil | 285/56 |

* cited by examiner

*Primary Examiner*—Tuan N. Nguyen
(74) *Attorney, Agent, or Firm*—Reising, Ethington, Barnes, Kisselle, P.C.

(57) ABSTRACT

An adjustable toilet flange assembly is disclosed for connecting a toilet with a waste pipe and to facilitate location of the flange on the upper surface of the floor even though the height of the floor surface above the waste pipe varies with different installations. The toilet flange assembly has an adapter pipe which is connected by a cemented joint with the waste pipe and has a hub with a female thread at its upper end. A flange member has a straight pipe section with an O-ring seal for making a telescopic connection inside the adapter member and having an annular flange on its upper end. A male thread on the pipe section adjacent the flange mates with the female thread of the adapter member and provides both height and angular adjustment of the flange.

11 Claims, 4 Drawing Sheets

ADJUSTABLE TOILET FLANGE ASSEMBLY

This application is based upon Provisional Application No. 60/252,449, filed Nov. 21, 2000, the priority of which is hereby claimed for this application.

FIELD OF THE INVENTION

This invention relates to plumbing fittings and more particularly, it relates to an adjustable toilet flange assembly for facilitating connection of a toilet to a waste pipe.

BACKGROUND OF THE INVENTION

There has been a longstanding need in the plumbing and construction industries for an adjustable toilet flange assembly which is of low cost, easy to install in both new construction and existing buildings, and which provides both height and angular adjustment with a leak-proof connection between the toilet and the waste pipe.

In the prior art, there have been many attempts to meet the need for an adjustable toilet flange assembly but none has succeeded in satisfying the needs of plumbers and builders at reasonable cost. Most commonly, the current practice in both new construction and remodeling, is to use non-adjustable toilet flanges. In such practice, as shown in FIG. 6, the toilet flange 1 is made of plastic, such as polyvinyl chloride (PVC). It is a one piece flange which comprises a round pipe portion with a unitary flange portion at its upper end; the lower end is adapted for connection through a stub pipe 2 to a street-elbow 3 which is connected to a waste pipe 4. In new construction, such as a new house, the plumbing is roughed in at an early stage before the walls and flooring are closed. In the rough plumbing for a toilet, for example, the street elbow 3 is connected to the waste pipe 4 which runs to the sewer line. The waste pipe is joined to the elbow by a cemented joint 5. The upper hub of the elbow 3 is positioned under a cut-out in the sub-flooring S of the house where the toilet is to be located. When the toilet flange 1 is to be installed, the stub pipe 4 is cut as necessary to the required length for connecting the pipe portion of the flange 1 to the elbow 3. The toilet flange is positioned for installation by disposing the pipe portion through a hole in the sub-flooring S with the flange resting on the sub-flooring or on shims to space the flange portion a suitable height above the sub-flooring to allow for the installation of finish flooring. The toilet flange is rotatably positioned so that the bolt holes in the flange are oriented properly for alignment with the mounting holes in the base of the toilet which is to be installed later. With flange 1 properly oriented, cemented joints 5' and 6 of the stub pipe are made. The installation of the toilet flange is completed by anchoring it to the sub-flooring by fasteners which extend through the flange portion. After the joints are cemented, it sometimes becomes necessary to change the height of the flange portion relative to the sub-flooring in order to accommodate a later selected finish flooring of greater thickness such as tile or marble. In this case, the existing toilet flange 1 and the elbow 3 have to be broken or cut at one or more cemented joints for removal and replacement. This is a costly procedure for changing a toilet connection during either new construction of a house or later remodeling.

In view of the current practice as described above there is a need for a low cost reliable toilet flange which can be adjusted in height and angular position during initial installation or later remodeling without destruction and replacement of fittings in the toilet connection.

There have been many attempts in the prior art to meet the need for an adjustable toilet flange. However, they have not met the requirements of low cost, reliability and simplicity. In U.S. Pat. No. 6,065,160 to Winn granted May 23, 2000 an adjustable toilet flange is described with a lower conduit which has screw threads adjacent the top end and an annular mounting flange adjacent the top end for securing the lower conduit to the underside of the floor. An upper conduit is provided with screw threads in its outer surface and an annular outer groove at the upper end. An annular bolt-down flange is rotatably disposed in the outer groove on the upper conduit for angular adjustment of the flange relative to the upper conduit. The upper conduit is connected with the lower conduit by the respective screw threads to provide for depth adjustment of the toilet flange.

U.S. Pat. No. 4,827,539 granted to Kaziah on May 9, 1989 discloses an adjustable closet flange having an upper member with an upper flange and a depending rib section with circular horizontal ribs joined by vertical ribs. It also has a lower flange member with an upstanding cylindrical collar adapted to receive the rib section of the upper flange member. Resilient retaining fingers attached to the lower member are insertable into spaces in the rib section for locking the upper and lower sections together at a desired height and angular orientation.

Other prior art patents pertaining to adjustable toilet flanges are: Dreier patent 872,331 granted Dec. 3, 1907; Farrell patent 903,280 granted Nov. 10, 1908; Oakes patent 1,042,465 granted Oct. 29, 1912; and McEwen patent 3,775,780 granted Dec. 4, 1973.

A general objective of this invention is to provide an improved adjustable toilet flange assembly and to overcome certain disadvantages of the prior art.

SUMMARY OF THE INVENTION

In accordance with this invention, an adjustable toilet flange assembly is provided comprising a flange member and an adapter member for connecting a toilet with a waste pipe having both height adjustment and angular adjustment of the flange member relative to the position of the drain pipe.

Further, in accordance with this invention, the flange member is removable from the adapter member or can be adjusted relative thereto without the need for removing the existing floor or plumbing and without installing a new flange member. This is accomplished by a threaded connection between the flange member and the adapter member together with a telescopic joint between the flange member and the adapter member with a fluid-tight seal in the joint.

Further, in accordance with this invention, the adapter member is angularly adjustable relative to the flange member through 360 degrees thus providing flexibility with respect to the final direction of the drain pipe.

Further, in accordance with this invention, a toilet flange assembly may be provided with a single standard size flange member and a selected adapter member which is appropriate for coupling with the existing drain pipe.

A complete understanding of this invention may be obtained from the detailed description that follows, taken with the accompanying drawings.

BEST MODE FOR CARRYING OUT THE INVENTION

Figure 1:
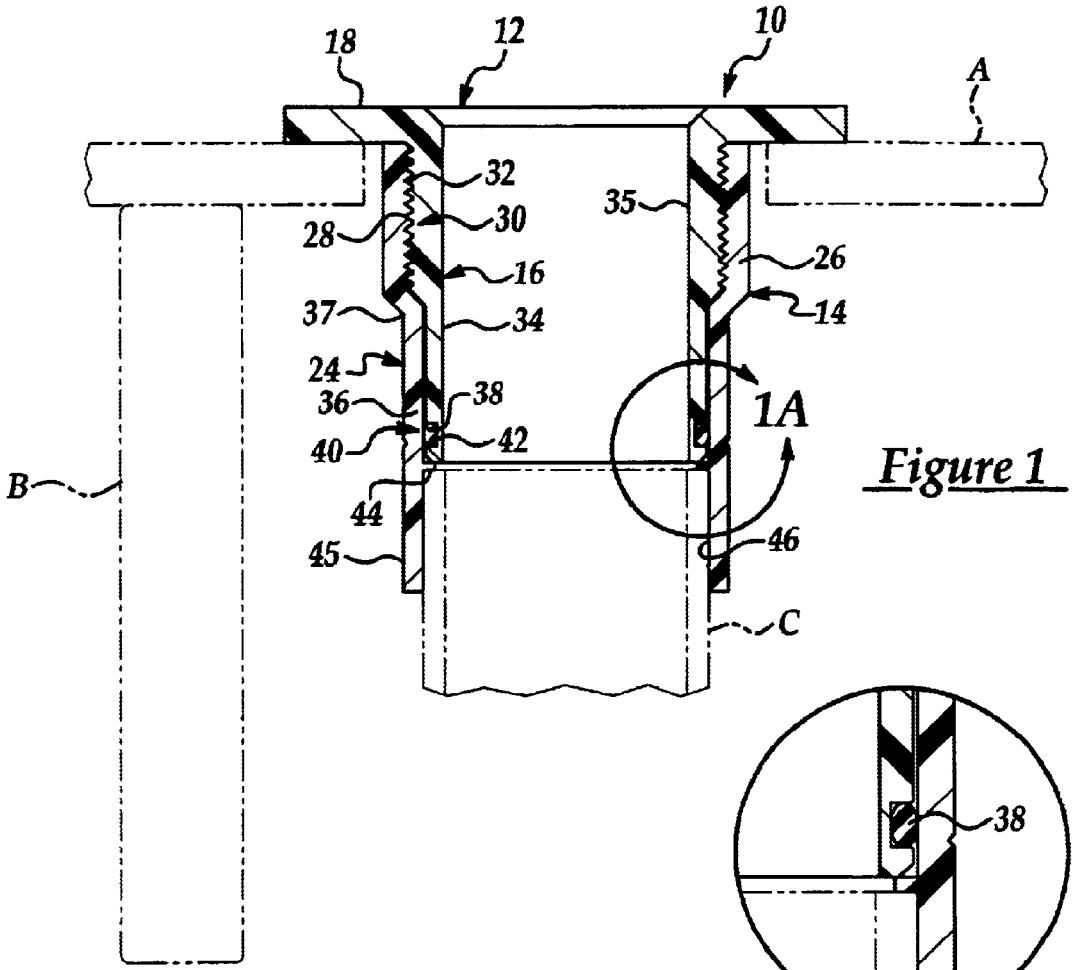
FIG. 1 is a cross-sectional view of a first embodiment of a toilet flange of this invention.
Figure 1A:
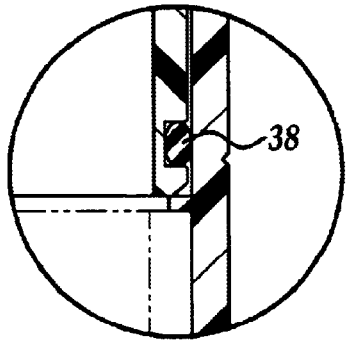
FIG. 1A is a magnified view of the encircled portion of FIG. 1.

Referring now to the drawings, there is shown an illustrative embodiment of this invention in an adjustable toilet flange assembly which provides for both height adjustment and angular adjustment between an upper flange member and a lower adapter member which, taken together, constitute a toilet flange assembly. It will be appreciated as the description proceeds that this invention is useful in many different applications and may be realized in various embodiments.

First Embodiment of the Toilet Flange Assembly

As shown in the exploded view of FIG. 1, the toilet flange assembly 10 comprises a flange member 12 and an adapter member 14. The two members are coupled together in a manner which will be described presently.

Figure 2A:
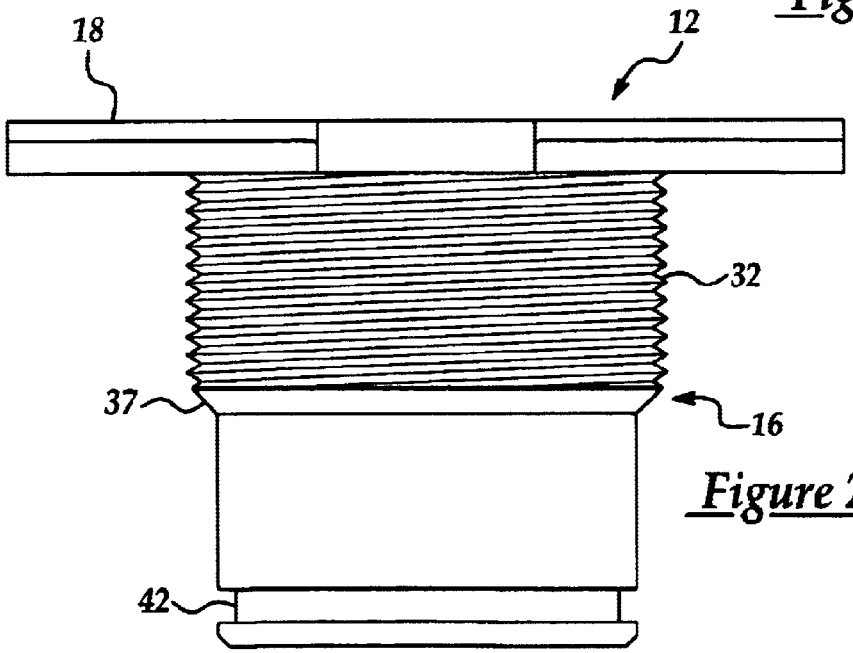
FIG. 2A is an elevation view of a flange member of this invention.
Figure 2B:
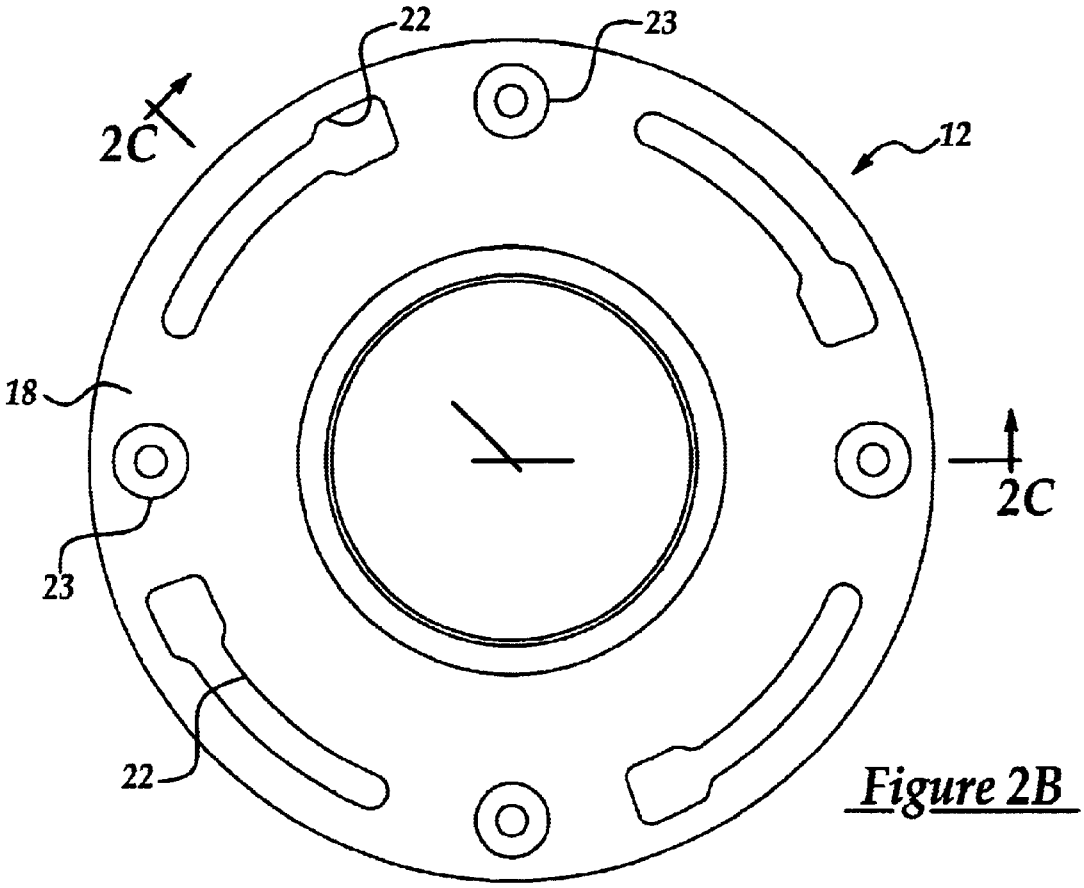
FIG. 2B is a top plan view of the flange member of FIG. 2A.
Figure 2C:
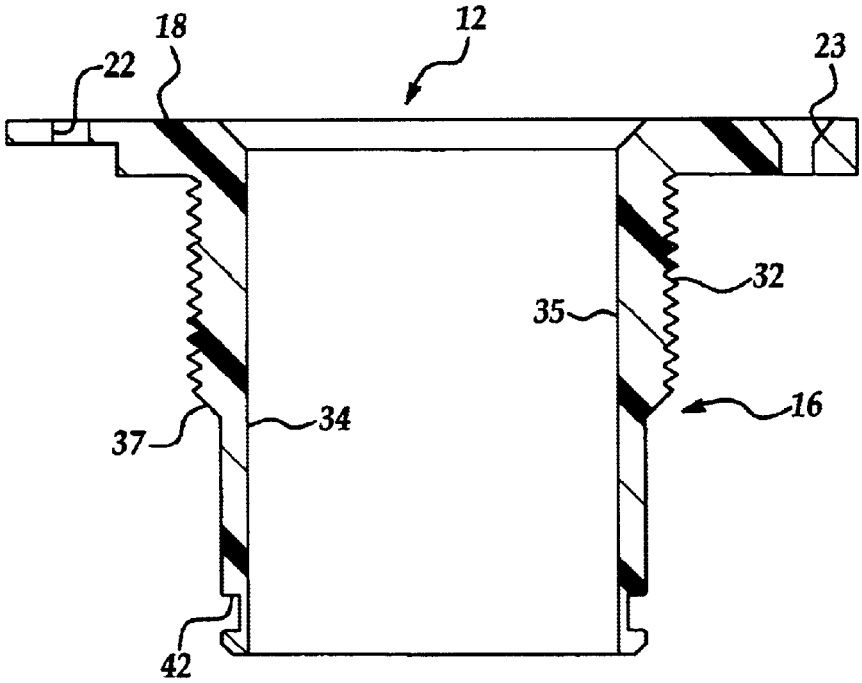
FIG. 2C is a cross-sectional view taken on lines 2C—2C of FIG. 2B.

The flange member 12 is adapted to extend down through the sub-flooring A of a building in a vertical orientation as shown. As shown in FIGS. 2A, 2B and 2C, the flange member 12 is generally of cylindrical shape and includes a straight pipe section 16 of circular cross-section with a uniform inside diameter. The pipe section 16 has a lower end 34 and an upper end 35 which is of greater wall thickness than the lower end. The pipe section 16 terminates in an annular flange 18 which is of unitary construction with the pipe section. The flange 18 is provided with a set of circumferentially spaced T-slots 22 which are located on the same radius and adapted to receive the head end of anchor bolts for holding the toilet bowl to the floor. The flange 18 may rest directly on the sub-flooring and be secured thereto by appropriate fasteners in screw holes 23.

The adapter member 14 (see FIGS. 1 and 5) comprises a straight pipe section 24 of circular cross-section having a uniform inside diameter. The adapter member 14 terminates in an upper end or hub 26 which will be further described below. The lower end 36 of the straight pipe section 24 constitutes a sealing zone which will be described below. The lower end 36 also includes a pipe connector socket 45 of uniform inside diameter with an internal shoulder or limit stop 44. The pipe section 24 terminates in a lower end which is adapted for connection with a drain pipe C by a cemented joint 46.

Both the adapter member 14 and the flange member 12 are preferably constructed of plastic such as polyvinyl chloride (PVC) or similar plastic material. Such material should be well suited for making cemented pipe joints using conventional plastic cement.

The hub 26 of the adapter member 14 is of enlarged diameter relative to the pipe section 24 and is provided on its inside diameter with conventional straight screw threads 28 of uniform root diameter. The pipe section 16 of the flange member 12 has an enlarged wall thickness at its upper end which is provided with male screw threads 32 adapted to mate with the female screw threads 28. The screw threads 32 and 28 provide a mechanical coupling between the flange member 12 and the adapter member 14 which provides for height adjustment of the flange member 12 relative to the adapter member 14 and it also provides for angular adjustment of the flange member relative to the angular orientation of the adapter member 14.

A telescopic connection is provided between the lower end 34 of the pipe section 16 of the flange member which is sized to fit in a clearance fit inside the lower end 36 of the pipe section 24 of the adapter member. A fluid tight slidable sealing means 40 is provided by an O-ring 38 which is nested in an annular groove 42 in the outside surface of the lower end 34 of the pipe section 16. The O-ring 38 coacts with the sealing zone in lower end 36 of pipe section 24 to provide a fluid tight seal at any adjusted axial position of the flange member 12 relative to the adapter member 14.

In use of the toilet flange assembly 10, the adapter member 14 may be installed by connecting its lower end in the cemented joint 46 with the existing drain pipe C under the sub-floor A. Then, the flange member 12 is inserted through the opening in the sub-floor and into the hub 26 of the adapter member 14. The lower end 34 of the flange member 12 extends below the threads 32 by a length which is somewhat greater than the length of the threads 28 in the hub 26. Accordingly, the insertion of the straight pipe section 16 flange member 12 is guided into the adapter member 14 by an annular shoulder 37 at the upper end 36 of the adapter member 14 until the male threads 32 are engaged with the female threads 28. The flange member 12 is rotated to advance the thread engagement until the flange member is adjusted to the floor level with the annular flange oriented in an angular position in which a pair of opposed T-slots 22 are in the desired location for installing the toilet. In this position the flange assembly 10 is secured to the floor by threaded fasteners extending through screw holes 23 in the flange 18. In the adjusted position of the flange member 12, the O-ring 38 is positioned in a sealing zone which extends between the annular shoulder 37 and the limit stop 44. The limit stop serves to limit the insertion of waste pipe C into the connector socket 45 and comprises an annular rib protruding inwardly of the inside diameter of the pipe section 24. The stop 44 is engaged by the lower end 34 of the flange member 12 in its lowest adjusted position.

Second Embodiment of the Toilet Flange Assembly

Figure 3:
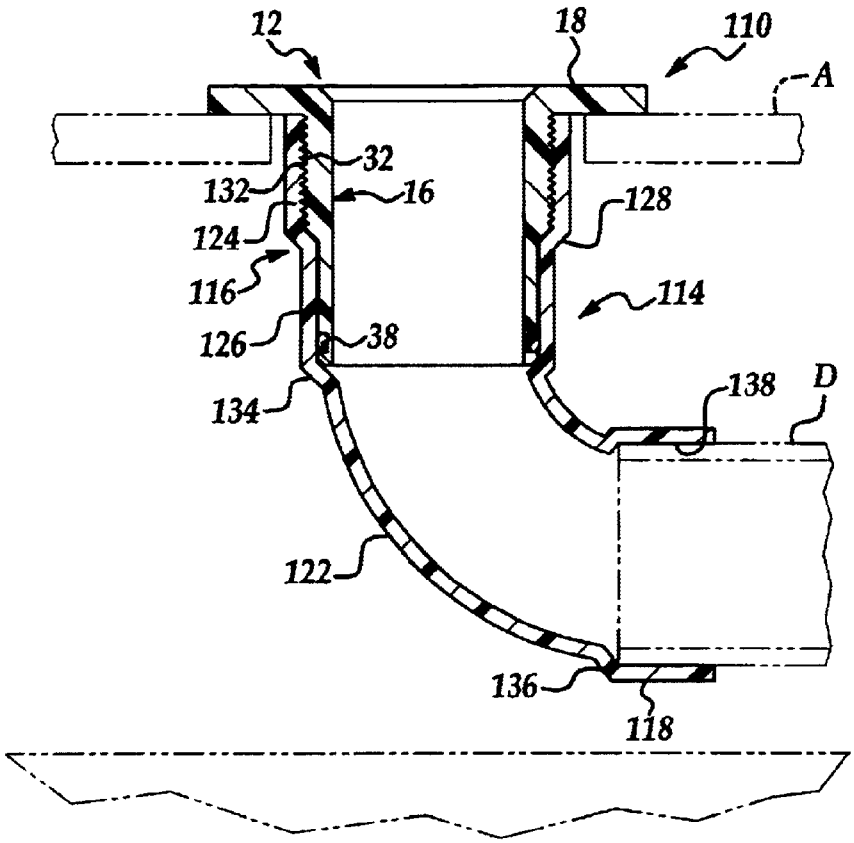
FIG. 3 is a cross-sectional view of a second embodiment of a toilet flange of this invention.

FIG. 3 shows a second embodiment of the invention in a toilet flange assembly 110 which is adapted for installation of a toilet fixture on the second floor of a typical two story house. In this type of installation, the toilet flange assembly 110 is connected between the toilet (not shown) and a laterally extending waste pipe D which runs between floor joists (not shown) and parallel thereto. This embodiment is similar to flange assembly 10 of FIG. 1 in that the flange member 12 is the same but the adapter member 114 differs from the adapter member 14 in that it is a ninety degree elbow instead of a straight pipe.

The adapter member 114 comprises, in general, an upper hub 116 and a lower hub 118 which are joined by an elbow section 122. The upper hub 116 is a two-stage hub comprising an outer hub 124 and an inner hub 126 which are joined by a shoulder 128 which reduces the inner hub 126 to a smaller diameter than that of the outer hub 124. The outer hub 124 is provided with female threads 132 which mate with the male threads 32 on the flange member 12. The inner hub 126 comprises a straight pipe section which extends between the upper shoulder 128 and a lower shoulder 134 which joins the inner hub 126 with the elbow section 122. The O-ring 38 in the flange member 12 coacts with the straight pipe section of the inner hub 126 and provides a seal therewith in the sealing zone between the upper shoulder 128 and the lower shoulder 134.

The lower hub 118 is joined by a shoulder 136 with the lower end of the elbow section 122. The lower hub 118 is connected with the lateral waste pipe D by a cemented joint 138 in a conventional manner.

In use of the toilet flange assembly 110, the adapter member 114 may be installed by first connecting its lower hub 118 to the existing drain pipe D with the cemented joint 138. Then, the flange member 12 is inserted through the opening in the sub-floor A and into the upper hub 116 of the adapter member 114. The insertion of the straight pipe section 16 into adapter member 114 is guided by the annular shoulder 128 until the male threads 32 on the flange member are engaged with the female threads 132 on the adapter member. The flange member 12 is then rotated to advance the thread engagement until the height of the flange member is adjusted to the floor level with the annular flange oriented in an angular position in which a pair of opposed T-slots 22 are properly located for installing the toilet. In this position the flange assembly 10 is secured to the floor by threaded fasteners extending through screw holes 23 in the flange 18. In the adjusted position of the flange member 12, the O-ring 38 is positioned in the sealing zone between the upper shoulder 128 and lower shoulder 134 in the adapter member 114.

Third Embodiment of the Toilet Flange Assembly

Figure 4:
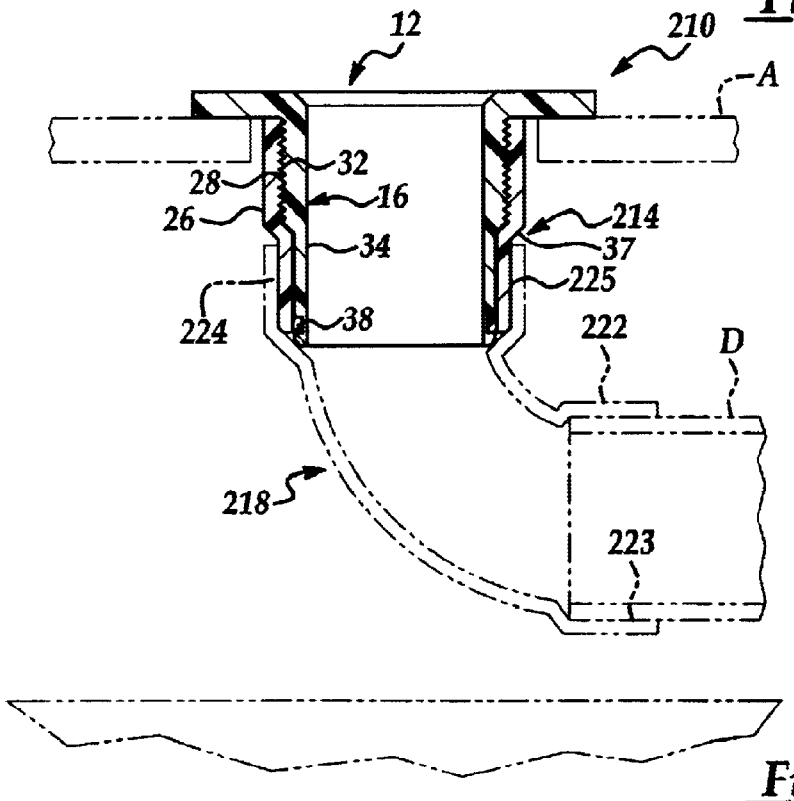
FIG. 4 is a cross-sectional view of a third embodiment of a toilet flange of this invention.

FIG. 4 shows a third embodiment of the invention which is useful for an installation similar to that shown in FIG. 3, described above. However, this embodiment utilizes a standard elbow, as will be described below, in conjunction with a toilet flange assembly of this invention.

As shown in FIG. 4, the toilet flange assembly 210 comprises, in general, the flange member 12 and an adapter member 214. In this assembly, the flange member 12 is identical to flange member 12 of FIG. 1. The adapter member 214 is the same as adapter member 14 except that it has a shorter axial length such that its lower end extends slightly beyond the O-ring 38 when the flange member 12 is screwed fully into the adapter member 214.

Figure 5:
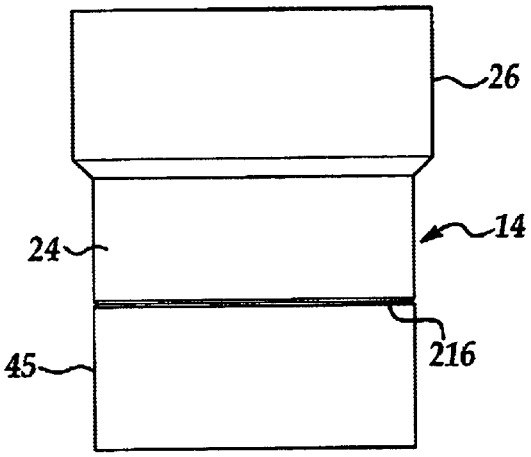
FIG. 5 is an elevation view of the adapter member of FIG. 1.
Figure 6:
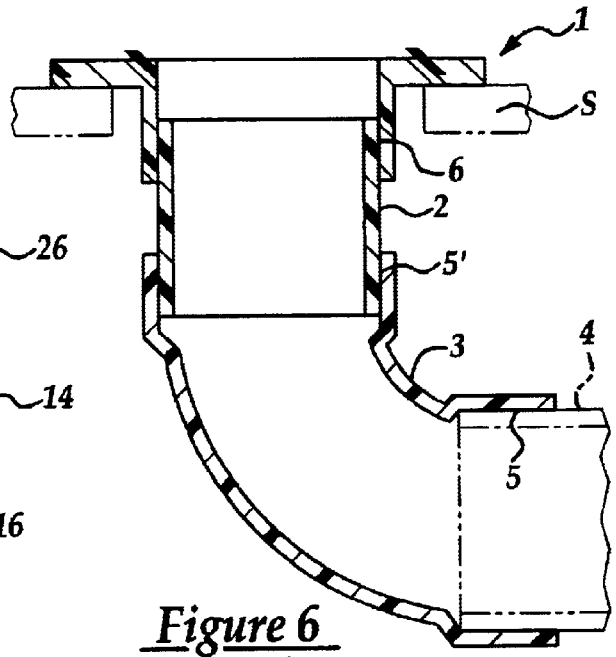
Figure 6 Prior Art
FIG. 6 is a cross-sectional view of a prior art toilet flange assembly.

For convenience and economy, the adapter member 214 can be provided by cutting off the lower end of the adapter member 14 as indicated in FIG. 5 which depicts the adapter member 14 with a cut-off groove 216. This groove 216 facilitates cutting off the lower end of an adapter member 14 and thus convert it to an adapter 214 when it is needed by the plumber working on the installation job.

In the embodiment of FIG. 4, the toilet flange assembly 210 is used for connecting the outlet waste conduit of the toilet to a lateral waste pipe D through a ninety degree reducing elbow 218. The reducing elbow 218 is of standard size in the plumbing industry for use with three inch I.D. (internal diameter) and three and one-half inch O.D. (outside diameter) waste pipe, such as waste pipe D. Accordingly, the lower hub 222 of the reducing elbow 218 has an I.D. of three and one-half inches whereas the upper hub 224 has an I.D. of four inches. The lower hub 222 receives the free end of the waste pipe D in a slip fit for making a cemented joint 223. The upper hub 224 of the elbow 218 is sized to receive the lower end of the adapter member 214 in a slip fit for making a cemented joint 225 between the adapter member and the elbow.

When the toilet flange assembly 210 is to be used, the standard elbow 218 is installed first by connecting it to the waste pipe D in the cemented joint 223. Then the adapter member 214 may be installed by connecting its lower end in the cemented joint 225 with the upper hub 224 of the of the elbow. Then, the flange member 12 is inserted into the hub 26 of the adapter member 214. The lower end 34 of the flange member 12 extends below the threads 32 by a length which is somewhat greater than the length of the threads 28 in the hub 26. Accordingly, the insertion of the straight pipe section 16 of the flange member 12 is guided into the adapter member 14 by an annular shoulder 37 at the upper end of the adapter member 214 until the male threads are engaged with the female threads. The flange member 12 is rotated to advance the thread engagement until the height of the flange member is adjusted to the floor level with the annular flange oriented in an angular position in which a pair of opposed T-slots 22 are in the desired location for installing the toilet. In this position the flange assembly 210 is secured to the floor by threaded fasteners extending through screw holes 23 in the flange. In the adjusted position of the flange member 12, the O-ring 38 is positioned in the sealing zone which extends between the annular shoulder of the adapter member 214 and its lower end.

Modification of the Toilet Flange Assembly

Figure 7:
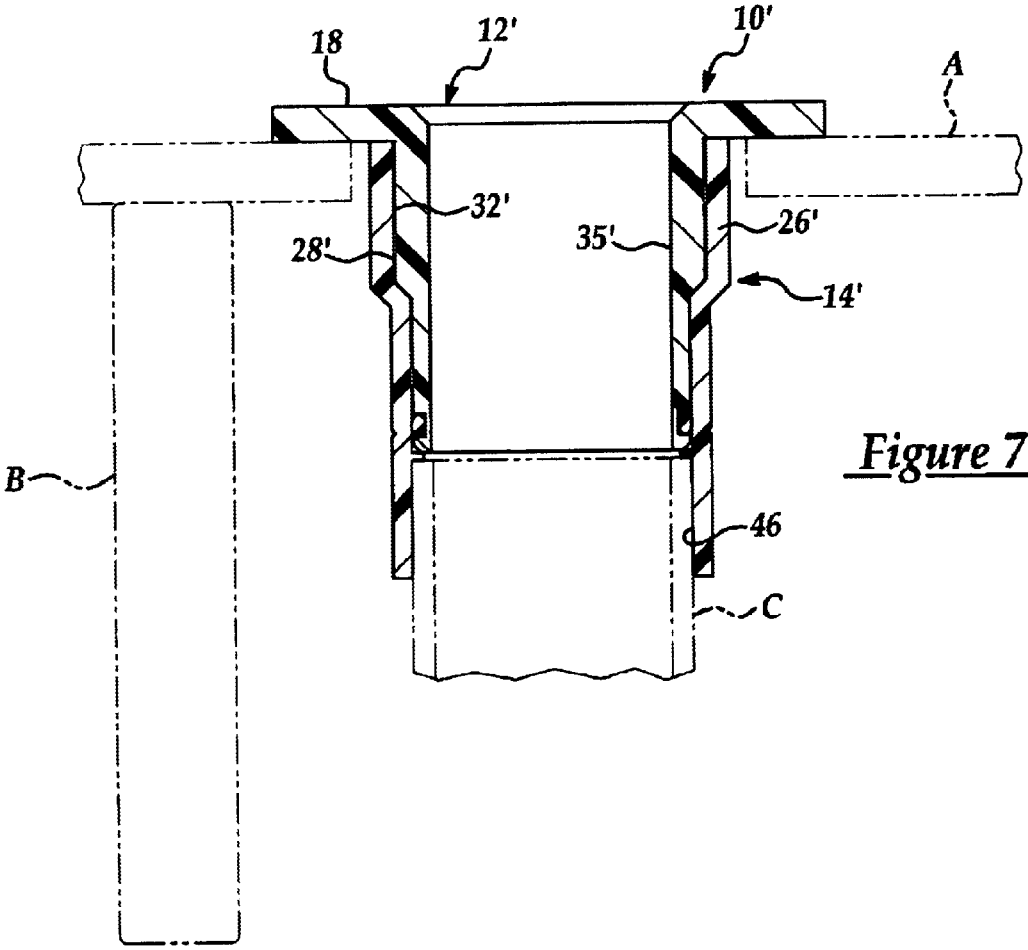
FIG. 7 is a cross-sectional view of a modified toilet flange assembly according to this invention.

FIG. 7 shows a toilet flange assembly 10' which is modified with reference to the first embodiment of the invention shown in FIG. 1 and described above. In this modification, the adapter member 14' is the same as the adapter member 14 of FIG. 1 except that the upper end 35' of the flange member 12' is provided with a smooth external surface 32' instead of the male threads 32. Similarly, the adapter member 14' of FIG. 7 is the same as the adapter member 14 of FIG. 1 except that the inner surface of the hub 26' is provided with a smooth interior surface 28' of uniform diameter instead of female threads 28 of FIG. 1. Further, the smooth surface 32' on the flange member 12' and the smooth surface 28' on the adapter member 14' are provided with a clearance fit such that the upper end 35' of the flange member can be fully inserted without interference into the hub 26'.

Use of the modified embodiment of FIG. 7 is the same as that described for use of the embodiment of FIG. 1 except that the flange member 12' is adjusted to the desired height with respect to the adapter member 14' by manually moving it in rectilinear motion instead of the rotative motion described with reference to the FIG. 1 embodiment. After the desired height adjustment is obtained, the flange member 12' is secured in the desired position by securing it to the sub-flooring A with screws in the screw holes 23.

It will be understood that the modified flange member 12' and the modified adapter member 14' may be provided in the toilet flange assemblies of the second and third embodiments of the invention shown in FIGS. 3 and 4, respectively.

Alternate Design Features of the Toilet Flange Assembly

Certain features of the toilet flange assembly of this invention are described above as being implemented with specific devices. In particular, the slidable sealing means 40 is implemented in the foregoing embodiments of the invention using an O-ring. Also, in particular, the position adjusting means 30 is implemented in the foregoing embodiments using screw threads. It will be understood that the toilet flange assembly of this invention may be realized by using alternate devices for implementing such design features. Examples of alternate devices for the sealing means and for the position adjusting means are given below.

Slidable Sealing Means

In place of the O-ring 38 and slot 42 a seal ring of rubber or plastic having a flat rectangular or oval cross-section disposed in an annular groove may be used as an alternate slidable sealing means. Also, the sealing means may comprise a fiber seal ring impregnated with a wax-based material. Further, a wide rubber sleeve stretched around the lower end of the flange member and seated in a wide annular groove may be used as an alternate slidable sealing means.

Instead of using a slidable sealing means such as an O-ring or other annular seal rings, the slidable sealing means may be dispensed with and a fluid sealing means between the flange member and the adapter member may be provided on the surfaces of the threads 28 and 32. For example, a conventional thread tape may be applied in a conventional manner. Also, a waterproof non-hardening pipe dope or sealant may be used in a conventional manner on the threads.

Alternate Devices for Position Adjusting Means

In place of using threads 28 and 32, each of the following devices may be used as an alternate position adjusting means. In place of the female threads 28, the interior surface of the hub 26 may be provided with a helical slot extending from the top to the bottom of the hub with one or more turns and providing the flange member 12 with a single protuberance on the external cylindrical and which is nested in the slot so as to cause the flange member to move up or down with reference to the adapter member by camming action when the flange member is rotated.

Further, in place of the threads 28 and 32, the adapter member 14 may be provided with a set of annular grooves in the interior wall of the hub 26 which are spaced apart from top to bottom of the hub in equal increments of spacing, each of the grooves being interrupted by a set of four equally spaced vertical grooves running from top to bottom of the hub. The flange member is provided with a set of four equally spaced protuberances which lie in the same plane half-way between the top and bottom of the straight pipe section 16. The set of radial protuberances are sized to fit in the vertical slots so as to allow the flange member to be raised or lowered and locked into a selected position by rotation sufficient to position the four protuberances within the confines of one of the annular grooves.

Another alternate device for the position adjusting means can comprise a detent arrangement between the adapter member and the flange member. In this, the adapter member is provided with one or more sets of detent recesses with the recesses in each set being arranged in a vertical column on the interior surface of the hub of the adapter member. The flange member is provided with a detent finger corresponding to each set of detent recesses. Each detent finger is unitary with the wall of the flange member at the lower end thereof and has its lower end attached in cantilever fashion to the wall. Each detent finger is provided with a protuberance on its outer surface which mates with one of the detent recesses when the detent finger is in its normal unstressed position in alignment with the adjacent portions of the wall. The detent fingers may be manually pressed inwardly to disengage the protuberance from the detent recesses which allows the flange member to be adjusted in height relative to the adapter member.

CONCLUSION

Although the description of this invention has been given with reference to a particular embodiment, it is not to be construed in a limiting sense. Many variations and modifications will now occur to those skilled in the art.

What is claimed is:

1. A toilet flange assembly for connecting a toilet to a floor of a building and to a plastic waste pipe disposed under said floor, said flange assembly comprising:

a plastic flange member including a first cylindrical pipe section having upper and lower end portions, said upper end portion terminating in an annular flange for connection with said toilet and said floor, said lower end portion having a first sealing zone, a plastic adapter member for connecting said flange member to said waste pipe, said adapter member including a second cylindrical pipe section having upper and lower end portions, said lower end portion of said second pipe section having a second sealing zone connected with a pipe socket connector member adapted for connection by a cemented joint with said plastic waste pipe, a telescopic connection between said lower end portion of said first pipe section and said lower end portion of said second pipe section whereby the axial and angular positions of said flange member can be adjusted relative to said adapter member, and fluid sealing means mounted on one of said pipe sections in the sealing zone thereof for movement therewith and disposed in sliding engagement with said sealing zone of the other of said pipe sections for maintaining a fluid seal therebetween, whereby said toilet flange assembly is installed by first connecting said pipe socket connector member to said waste pipe by a cemented joint and then adjusting the flange member to desired angular and axial positions for fastening the flange member to the floor and whereby the angular and axial positions of said flange member may be changed after installation to accommodate a different floor level or toilet orientation without need for changing said cemented joint.

2. The toilet flange assembly as defined in claim 1 wherein said assembly comprises:

external screw threads on the upper end of said first pipe section and internal screw threads on the upper end of said second pipe section in mating engagement with said external screw threads for adjusting the angular and axial positions of said flange member relative to said adapter member.

3. The toilet flange assembly as defined in claim 1 wherein said fluid sealing means comprises:

an annular groove in said lower end portion of one of said pipe sections, and an annular seal ring disposed in said groove in sealing engagement with both of said first and second sealing zones.

4. The toilet flange assembly as defined in claim 3 wherein said one of said pipe sections is said first pipe section.

5. The toilet flange assembly as defined in claim 4 wherein said annular seal ring is an O-ring.

6. The toilet flange assembly as defined in claim 1 wherein said pipe socket connector and said second sealing zone are straight pipe sections with an internal annular shoulder therebetween.

7. The toilet flange assembly as defined in claim 6 wherein said adapter member has a cut-off groove above said annular shoulder whereby said adapter member can be used with or without said pipe socket connector member.

8. A plastic toilet flange assembly for connecting a toilet to a floor of a building, and to a plastic waste pipe disposed under said floor, said flange assembly comprising:

a plastic flange member including a first pipe section having upper and lower end portions, said upper end portion terminating in a unitary annular flange for connection with said toilet and said floor, a plastic adapter member including a second pipe section having upper and lower end portions, said lower end portion of said second pipe section terminating in a pipe socket connector member adapted for connection by a cemented joint a telescopic connection between said first pipe section and said second pipe section with said first pipe section inside said second pipe section, whereby the axial and angular position of said flange member can be adjusted relative to said adapter member, and fluid sealing means disposed in said telescopic connection and carried solely by one of said first and second pipe sections in slidable engagement with the other of said first and second pipe sections, whereby said toilet flange assembly is installed by first connecting said pipe socket connector member to said waste pipe by a cemented joint and then adjusting the flange member to desired angular and axial positions for fastening the flange member to the floor and whereby the angular and axial positions of said flange member may be changed after installation to accommodate a different floor level or toilet orientation without need for changing said cemented joint.

9. The toilet flange assembly as defined in claim 8 wherein said fluid sealing means comprises:

an annular groove in said lower portion end of one of said pipe sections, and an annular seal ring disposed in said groove in sealing engagement with both of said pipe sections.

10. The toilet flange assembly as defined in claim 8 wherein;

said upper end of said first pipe section has a greater wall thickness then said lower end and said upper end of said second pipe section terminates in an enlarged hub for receiving said upper end of said first pipe section.

11. The toilet flange assembly as defined in claim 10 wherein:

said assembly comprises external screw threads adjacent the upper end of first said pipe section and internal screw threads adjacent the upper end of said second pipe section for mating engagement with said external screw threads.

* * * * *